US008123043B2

(12) United States Patent
McGregor et al.

(10) Patent No.: US 8,123,043 B2
(45) Date of Patent: Feb. 28, 2012

(54) SCREENING MODULE RETAINING ASSEMBLY

(75) Inventors: Ron K. McGregor, Cooks Hill (AU); Ron Johnson, Charlestown (AU)

(73) Assignee: Ludowici Australia Pty Ltd., Brisbane (AU)

( * ) Notice: Subject to any disclaimer, the term of this patent is extended or adjusted under 35 U.S.C. 154(b) by 424 days.

(21) Appl. No.: 11/946,175

(22) Filed: Nov. 28, 2007

(65) Prior Publication Data

US 2008/0121568 A1 May 29, 2008

(30) Foreign Application Priority Data

Nov. 28, 2006 (AU) ..... 2006243879

(51) Int. Cl.
*B07B 1/46* (2006.01)

(52) U.S. Cl. ..... 209/405; 209/319

(58) Field of Classification Search ..... 209/399, 209/403, 405, 319
See application file for complete search history.

(56) References Cited

U.S. PATENT DOCUMENTS

| | | | | | |
|---|---|---|---|---|---|
| 3,029,912 | A | | 4/1962 | Barker | |
| 4,141,821 | A | * | 2/1979 | Wolff | 209/405 |
| 4,409,099 | A | * | 10/1983 | Wolff | 209/399 |
| 4,757,664 | A | * | 7/1988 | Freissle | 52/509 |
| 4,871,288 | A | * | 10/1989 | Schmidt et al. | 411/45 |
| 4,909,929 | A | * | 3/1990 | Tabor | 209/400 |
| 4,990,023 | A | | 2/1991 | Angelov | |
| 5,277,319 | A | * | 1/1994 | Henry, Jr. | 209/399 |
| 6,206,200 | B1 | * | 3/2001 | Gilles et al. | 209/399 |
| 6,715,613 | B2 | * | 4/2004 | Eeles et al. | 209/405 |
| 6,957,741 | B2 | * | 10/2005 | Freissle et al. | 209/405 |
| 6,964,341 | B2 | | 11/2005 | Bacho et al. | |
| 7,066,334 | B2 | | 6/2006 | Eeles et al. | |
| 7,273,151 | B2 | | 9/2007 | Sawall et al. | |
| 7,467,715 | B2 | | 12/2008 | Johnson et al. | |
| 2003/0038060 | A1 | | 2/2003 | Freissle et al. | |
| 2006/0108264 | A1 | * | 5/2006 | Moore et al. | 209/395 |
| 2008/0121568 | A1 | | 5/2008 | McGregor et al. | |

FOREIGN PATENT DOCUMENTS

| | | |
|---|---|---|
| AU | 199346121 A1 | 2/1993 |
| CL | 37372 | 7/1990 |
| CL | 1429-97 | 7/1997 |
| CL | 108-2000 | 1/2000 |
| CL | 1010-2000 | 4/2000 |

(Continued)

*Primary Examiner* — Joseph C Rodriguez
(74) *Attorney, Agent, or Firm* — Wong, Cabello, Lutsch, Rutherford & Brucculeri, L.L.P.

(57) ABSTRACT

A screening module retaining assembly 10 includes a body member 12 defining a passage 14. The body member 12 further includes a locating formation 16, associated with a first end 18 of the body member 12, for engaging a screening module to assist in retaining the screening module relative to a screen deck A retaining element 20 is displaceably arranged in the passage 14, the retaining element 20 being displaceable between a first, non-retaining position in which the retaining element 20 is accessible from the first end of the body member 12 and a second, retaining position in which the retaining element 20 is received within the passage 14 and acts on at least a part of the body member 12 for retaining the body member 12 in position relative to a component of the screen deck. A head portion 22 of the retaining element 20 defines a receiving formation 40 for receiving a complementary formation of the screening module to assist in laterally retaining the screening module relative to the screen deck.

20 Claims, 3 Drawing Sheets

FOREIGN PATENT DOCUMENTS

| | | | |
|---|---|---|---|
| CL | 1780-2002 | | 8/2002 |
| CL | 2895-2005 | | 11/2005 |
| CL | 3055-2005 | | 11/2005 |
| CL | 908-2006 | | 4/2006 |
| CL | 3287-2006 | | 11/2006 |
| DE | 3607660 | A1 | 9/1987 |
| DE | 4136898 | A1 | 11/1991 |
| GB | 2262581 | | 6/1993 |
| WO | 03047771 | | 6/2003 |
| WO | 2006034526 | | 4/2006 |
| WO | 2007060633 | | 5/2007 |

* cited by examiner

SCREENING MODULE RETAINING ASSEMBLY

CROSS-REFERENCE TO RELATED APPLICATIONS

This claims priority to Australian Application No. 2006243879, filed Nov. 28, 2006 which is incorporated herein by reference.

FIELD OF THE INVENTION

This invention relates to ore screening systems. More particularly, the invention relates to a screening module retaining assembly and to a screening system including such retaining assembly.

BACKGROUND TO THE INVENTION

Screening systems are used for classifying ores. These screening systems use foraminous screening modules which pass material of a predetermined size and block material of larger size.

The screening modules are removably attached to a screen deck as they wear rapidly and need to be replaced. Various forms of attachment are used for attaching screening modules to the screen deck. These forms of attachment include rails, pins, or other attachment elements which releasably retain the screening modules on the screen deck.

One problem with these different arrangements is that, if the screen deck is configured to have screening modules with an attaching system of a first type attached to the screen deck, the screen deck cannot be used with screening modules of a type having a different attaching system.

In certain situations, the means by which the screening modules are attached to the screen deck stand proud of an upper surface of the screening modules. A problem with this arrangement is that it reduces the screening area of the screening modules and impedes flow of material over the upper surfaces of the screening modules.

SUMMARY OF THE INVENTION

According to a first aspect of the invention, there is provided a screening module retaining assembly which includes:

a body member defining a passage, the body member further including a locating formation, associated with a first end of the body member, for engaging a screening module to assist in retaining the screening module relative to a screen deck; and a retaining element displaceably arranged in the passage, the retaining element being displaceable between a first, non-retaining position in which the retaining element is accessible from the first end of the body member and a second, retaining position in which the retaining element is received within the passage and acts on at least a part of the body member for retaining the body member in position relative to a component of the screen deck, a head portion of the retaining element defining a receiving formation for receiving a complementary formation of the screening module, when the retaining element is in its second position, to assist in laterally retaining the screening module relative to the screen deck.

The body member may be a moulding of a resiliently flexible material. For example, the body member may be a moulding of a polymeric material such as a polyurethane material.

The body member may comprise a boss which defines the first end of the body member. A screen deck engaging assembly may extend from, and be formed integrally with, the boss. A free end of the engaging assembly may define a second end of the body member. The passage may be an open passage extending from the first end of the body member to the second end of the body member. The retaining element may be at least the same length as the body member and, possibly, longer so that, when the retaining element is driven into its second, retaining position relative to the body member, a distal portion of the retaining element projects beyond the second end of the body member.

The engaging assembly may comprise a plurality of engaging elements, each being in the form of a wing. The wings may be separated from each other by slots extending from the second end of the body member towards the first end of the body member, terminating short of the boss of the body member.

In one embodiment, the locating formation of the body member may be in the form of a radially outwardly extending lip defined at, or adjacent, the first end of the body member, the lip engaging a complementary recess of the screening module.

The receiving formation of the retaining element may be in the form of a socket defined in the head of the retaining element.

The complementary formation of the screening module may be in the form of a lug received in the socket. It will be appreciated that, in use, two screening modules are arranged side by side over the retaining assembly. Thus, each lug may be semicircular in cross section to form, together, a spigot which is a snug fit in the socket in the head of the retaining element.

According to a second aspect of the invention, there is provided a screening system which includes: — at least one retaining assembly, as described above, mountable to an underlying rail of screen deck; and at least one screening module releasably attachable to the at least one retaining assembly, the screening module including a frame portion mountable on the body member of the at least one retaining assembly, the frame portion having a recess to receive a part of the body member and an engaging formation which engages the head of the retaining element of the retaining assembly, the screening module further including a screening panel portion carried by the frame portion.

The frame portion may include a recess proximate each corner of the frame portion so that the frame portion can be mounted in any desired direction on the screen deck. In use, each of two opposed sides of the frame portion may be secured to an underlying rail of the screen deck by a pair of spaced retaining assemblies. Each retaining assembly may be received in a recess in the frame portion.

The frame portion may include a recess proximate each corner of the frame portion so that the frame portion can be mounted in any desired direction on the screen deck.

Preferably, the frame portion comprises an intermediate frame to which the screening panel portion is releasably attached. An upper surface of the intermediate frame may carry a clip formation on which the screening panel portion is releasably clipped, for use. Thus, it will be appreciated that the screening panel can be a tear-off type panel to render it readily replaceable without disturbing the underlying intermediate frame or the retaining assemblies securing the intermediate frame to the screen deck.

The screening module may be square in plan view.

BRIEF DESCRIPTION OF DRAWINGS

An embodiment of the invention is now described by way of example with reference to the accompanying drawings in which.

DETAILED DESCRIPTION OF EXEMPLARY EMBODIMENT

Figure 8:
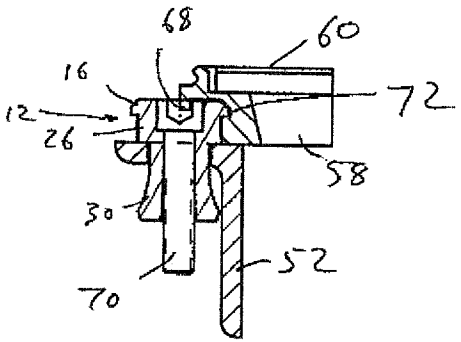
FIG. 8 shows a sectional side view of a part of the screening system.

Referring initially to FIGS. 1 to 4 of the drawings, an embodiment of a screening module retaining assembly is illustrated and is designated generally by the reference numeral 10. The module 10 includes a body member 12 defining a passage 14. The body member 12 further includes a radially outwardly extending locating formation in the form of a lip 16 at a first end 18 of the body member 12. As will be described in greater detail below, the lip 16 engages a screening module of a screening system to assist in retaining the screening module relative to a screen deck. A retaining element in the form of a socket head cap screw 20 is displaceably received in the passage 14 of the body member 12. The cap screw 20 is displaceable between a first, non-retaining position in which the cap screw 20 is accessible from the first end 18 of the body member 12 and a second, retaining position, as shown in FIG. 8 of the drawings, in which the cap screw 20 is received within the passage 14 of the body member 12.

Figure 1:
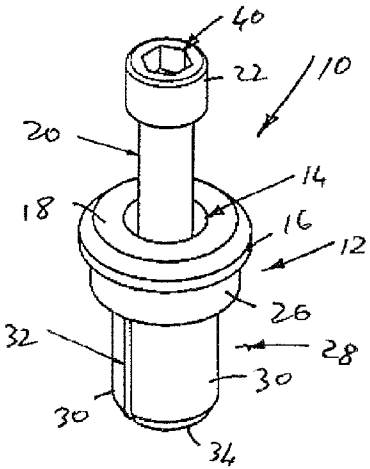
FIG. 1 shows a three dimensional view of an embodiment of a screening module retaining assembly.
Figure 2:
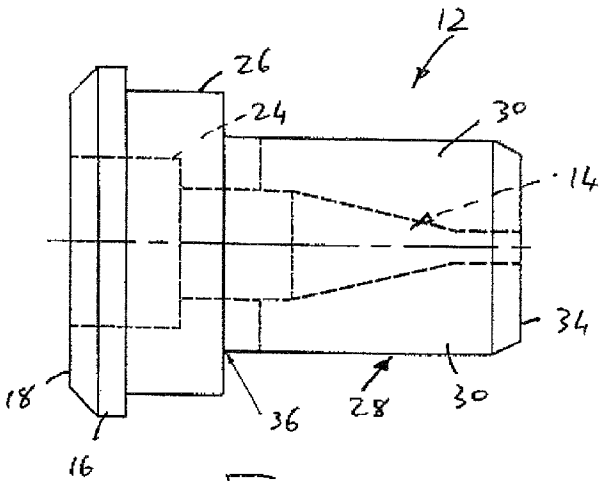
FIG. 2 shows a side view of a part of the assembly of FIG. 1.
Figure 3:
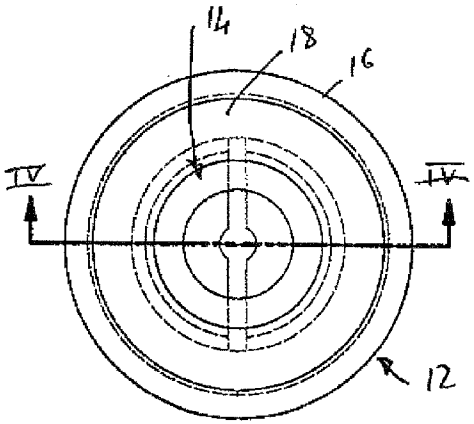
FIG. 3 shows a plan view of the part of FIG. 2.
Figure 4:
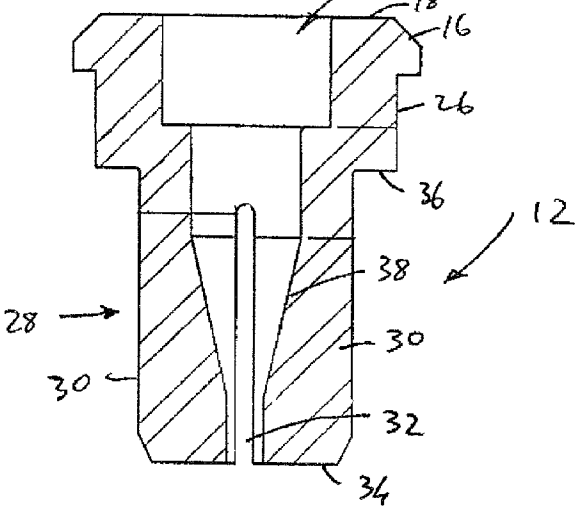
FIG. 4 shows a sectional side view of the part taken along line IV-IV in FIG. 3.
Figure 6:
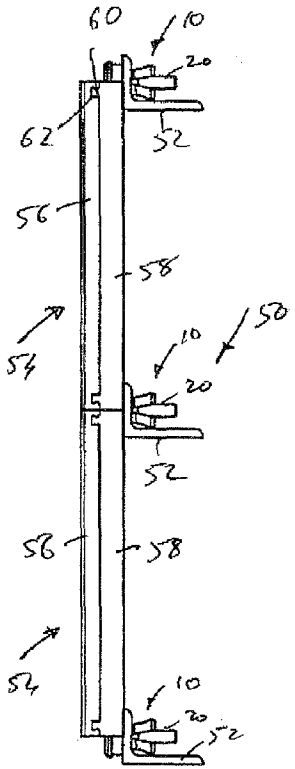
FIG. 6 shows an end view of the part of the screening system of FIG. 5.

To accommodate a head 22 of the cap screw 20, an operatively upper end of the passage 14 is counterbored as shown at 24 in FIGS. 2 and 4 of the drawings.

The body member 12 of the assembly 10 comprises a boss 26 defining the first end 18 of the body member 12. The body member 12 further includes a screen deck engaging assembly 28 extending from the boss 26. The screen deck engaging assembly 28 is in the form of a pair of opposed engaging elements, each in the form of a wing 30. The wings 30 are arranged diametrically opposed to each other and are separated from each other by a pair of opposed longitudinally extending slots 32. The slots 32 extend from a second end 34 of the body member towards the first end 18 of the body member 12 terminating short of a lower edge 36 of the boss 26. It is also to be noted that the passage 14 tapers inwardly towards the second end 34 of the body member 12 as shown at 38 in FIGS. 2 and 4 of the drawings. This assists in causing flaring of the wings 30 of the engaging assembly when the cap screw 20 is displaced from its first position to its second position.

The body member 12 is a one-piece moulding of a suitable resiliently flexible material. More particularly, the body member 12 is a moulding of a polymeric material such as a polyurethane material having the required Shore hardness.

The cap screw 20 defines an Allen key recess or socket 40 in its head 22. The socket 40 serves as a receiving formation for receiving a complementary formation of a screening module of the screening system as will be described below with reference to FIGS. 5 to 8 of the drawings.

Referring now to FIGS. 5 to 8 of the drawings, an embodiment of a screening system is shown and is illustrated generally by the reference numeral 50. The screening system 50 comprises a screen deck 51 on which a plurality of screen deck rails 52 are arranged in parallel, spaced relationship. Apertures are defined at longitudinally spaced intervals along each rail 52. Each aperture is dimensioned to receive the engaging assembly 28 of a retaining assembly 10 through it.

Figure 5:
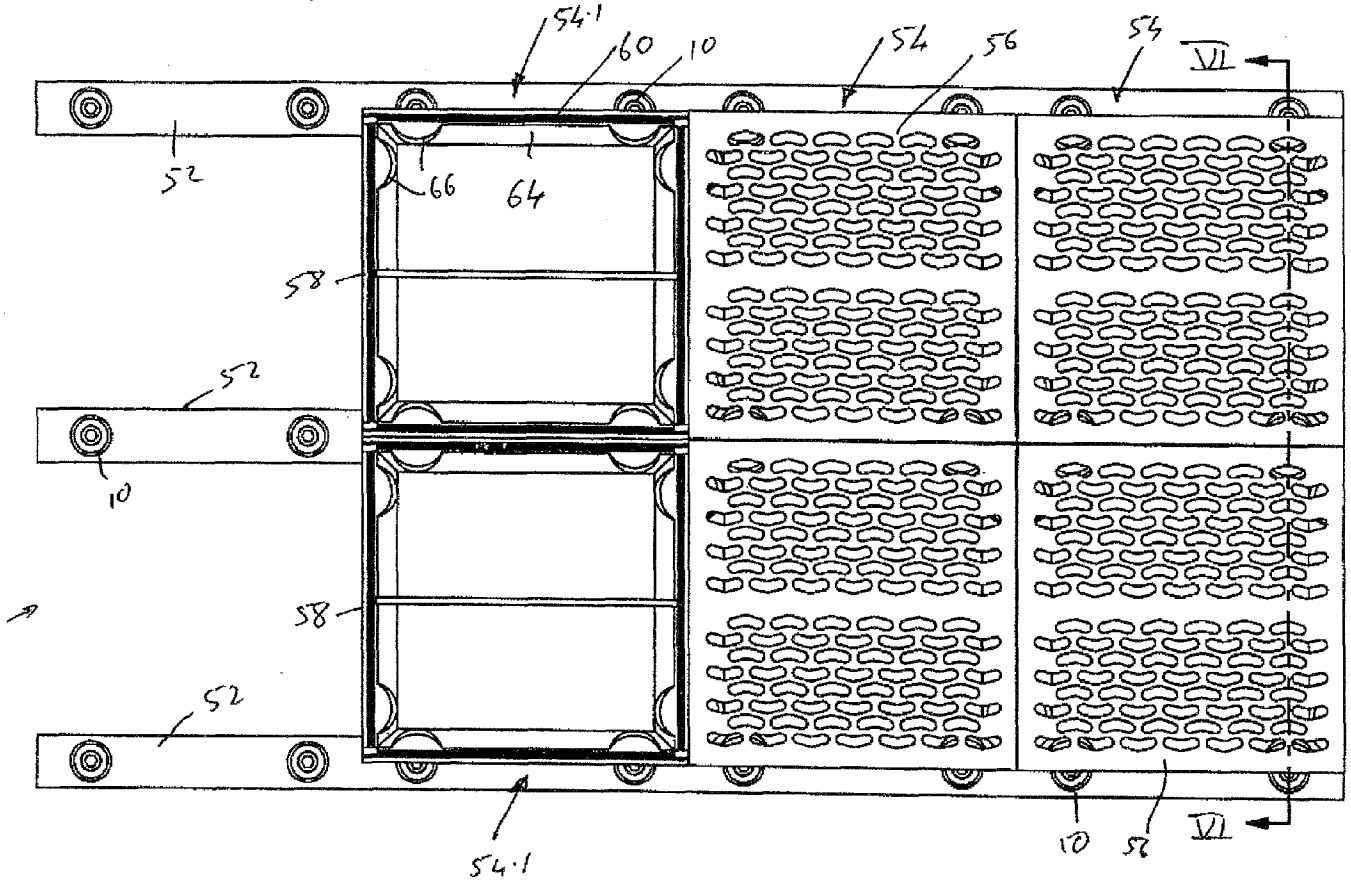
FIG. 5 shows a plan view of part of an embodiment of a screening system.

The screening system 50 further includes a plurality of screening modules 54 which are arranged in side-by-side relationship on the rails 52 as shown in FIG. 5 of the drawings. It is to be noted that, in respect of each of modules 54.1, a screening panel 56 of the screening module 54 is omitted to show the mounting of a frame portion in the form of an intermediate frame 58 on the rails 52.

In this embodiment, each screening module 54 comprises the intermediate frame 58 on which the screening panel 56 is removably received. For this purpose, a periphery of each intermediate frame 58 of each module 54 carries a clip formation 60. The clip formation 60 is received in a complementary recess 62 in a periphery of the screening panel 56 for enabling the screening panel to be removably mounted on its associated frame 58. In other words, the screening panel 56 is a tear-off element and can be replaced without replacing the underlying frame 58 of the screening module 54. It will be appreciated that the screening module 54 could be of a unitary construction, i.e. that the screening panel portion 56 is formed integrally with the frame portion as a one piece moulding or as two separate mouldings that are subsequently bonded fast with each other.

Each screening module 54 is substantially square in plan view and has dimensions of roughly 300 mm by 300 mm. Each side 64 of each intermediate frame has a pair of spaced recesses 66 so that the intermediate frame 58 can be mounted in any desired orientation on the underlying rails 52. Thus, the screening modules 54 can be arranged in a with-flow arrangement on the screen deck 51 or in a cross-flow arrangement. Instead, dedicated with-flow, cross-flow or heavy duty modules 54 can be provided with recesses 66 in the appropriate sides 64 of the intermediate frame 58.

Each recess 66 is shaped to accommodate approximately half of the boss 26 of the body member 12 of an underlying retaining assembly 10 in it. As shown in greater detail in FIGS. 7 and 8 of the drawings, a downwardly extending lug 68 projects into the recess 66 of the frame 58. This lug 68 is received in the socket 40 in the head 22 of the cap screw 20.

Figure 7:
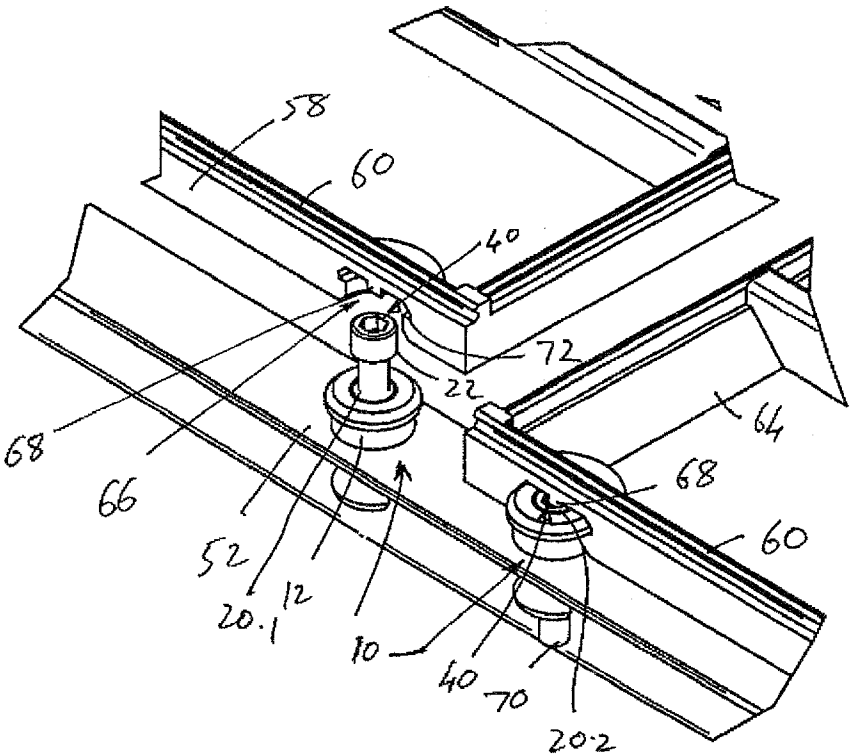
FIG. 7 shows a three dimensional view of a part of the screening system during assembly.

Thus, in use, a retaining assembly 10 is inserted into one of the apertures in the rail 52 with the cap screw 20 in the position shown at 20.1 in FIG. 7 of the drawings. The cap screw 20 is then driven home to the position shown at 20.2 in FIG. 7 of the drawings where a distal part of a shank 70 of the cap screw 20 projects beyond the second end 34 of the body member 12 of the assembly 10. As the screw 20 is driven from the position shown at 20.1 to the position shown at 20.2 in FIG. 7 of the drawings, it causes the wings 30 of the engaging assembly to flare outwardly due to engagement of the tapered part 38 of the passage 14 by the shank 70 of the cap screw 20. This serves to anchor the body member 12 in position on the rail 52.

An intermediate frame 58 is mounted on a pair of the assemblies 10 on each of a pair of adjacent rails 52 of the screen deck 51. The lip 16 of each body member 12 engages a shoulder formation 72 in the associated recess 66 of the intermediate frame 58. This serves to locate the frame 58 relative to the assemblies 10 and, therefore, relative to the intermediate rails 52 of the screen deck 51.

In addition, the lug 68 is received in the socket 40 of the head 22 of the cap screw 20. The lug 68 is semicircular in cross-section and, when two intermediate frames 58 are arranged side by side as shown in FIG. 7 of the drawings, two lugs 68 together, make up a spigot which is a snug fit in the socket 40 of each screw 20 of the pair of assemblies 10. The lugs 68 serve to locate the intermediate frames 58 of the screening modules 54 laterally with respect to each other and to improve the integrity of the mounted screening modules on the rails 52 of the screen deck 51.

It is an advantage of the invention that a screening system 50 is provided which is more versatile in that, by use of the retaining assemblies 10, a screen deck can be modified to accept screening modules 54 which are either of the pin attaching type or of the rail/clip attaching type. Hence, with the provision of the retaining assemblies 10, screening modules 54 can be used with either a pin-type screen deck or a rail-type screen deck. In addition, the use of a cap screw as the retaining element improves the strength of the retaining assembly 10 and, as a result, improves the lateral retention of the screening modules 54 on the rails 52 of the screen deck.

Still further, the assembly 10 can be provided with the cap screw 20 partially driven into the passage 14 so that threads of the screw bite into the wall of the passage 14 to retain the cap screw 20 in its first position relative to the body member 12 of the assembly 10. In this way, the likelihood of losing the screw, prior to use, in the hostile environment in which the screens decks are often used is reduced.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The claims defining the invention are as follows:

1. A screening system comprising:

a body member defining a passage, the body member further including a locating formation, associated with a first end of the body member, for engaging a screening module to assist in retaining the screening module relative to a screen deck; and a retaining element displaceably arranged in the passage, the retaining element being displaceable between a first, non-retaining position in which the retaining element is accessible from the first end of the body member and a second, retaining position in which the retaining element is received within the passage and acts on at least a part of the body member for retaining the body member in position relative to a component of the screen deck, a head portion of the retaining element having a receiving formation therein for receiving an engaging formation of the screening module, when the retaining element is in its second position, to assist in laterally retaining the screening module relative to the screen deck; and at least one screening module releasably attachable to the body member, by a frame portion mountable over the body member and the retaining element, the frame portion having a recess to receive a part of the body member and an engaging formation which engages the receiving formation located within the head of the retaining element, the screening module further including a screening panel portion carried by the frame portion.

2. The system of claim 1 in which the body member is a moulding of a resiliently flexible material.

3. The system of claim 2 in which the body member comprises a boss which defines the first end of the body member.

4. The system of claim 1 in which the body member comprises a boss which defines the first end of the body member.

5. The system of claim 3 in which a screen deck engaging assembly extends from, and is formed integrally with, the boss, a free end of the engaging assembly defining a second end of the body member.

6. The system of claim 5 in which the passage is an open passage extending from the first end of the body member to the second end of the body member.

7. The system of claim 6 in which the engaging assembly comprises a plurality of engaging elements.

8. The system of claim 5 in which the engaging assembly comprises a plurality of engaging elements.

9. The system of claim 8 in which the engaging elements are separated from each other by slots extending from the second end of the body member towards the first end of the body member, terminating short of the boss of the body member.

10. The system of claim 7 in which the engaging elements are separated from each other by slots extending from the second end of the body member towards the first end of the body member, terminating short of the boss of the body member.

11. The system of claim 10 in which the locating formation of the body member is in the form of a radially outwardly extending lip defined at, or adjacent, the first end of the body member, the lip engaging a complementary recess of the screening module.

12. The system of claim 9 in which the locating formation of the body member is in the form of a radially outwardly extending lip defined at, or adjacent, the first end of the body member, the lip engaging a complementary recess of the screening module.

13. The system of 1 in which the receiving formation of the retaining element is in the form of a socket defined in the head of the retaining element.

14. The system of claim 1 in which the frame portion includes a recess proximate each corner of the frame portion so that the frame portion can be mounted in any desired direction on the screen deck.

15. The system of claim 1 in which the frame portion comprises an intermediate frame to which the screening panel portion is releasably attached.

16. The system of claim 1 in which the frame portion comprises an intermediate frame to which the screening panel portion is releasably attached.

17. The system of claim 15 in which an upper surface of the intermediate frame carries a clip formation on which the screening panel portion is releasably clipped, for use.

18. The system of claim 14 in which an upper surface of the intermediate frame carries a clip formation on which the screening panel portion is releasably clipped, for use.

19. The system of claim 1 in which the screening module is square in plan view.

20. A retaining assembly for a screening system having at least one screen module, the retaining assembly comprising:

a body member defining a passage, the body member further including a locating formation, associated with a first end of the body member, for engaging a screening module to assist in retaining the screening module relative to a screen deck; and a retaining element displaceably arranged in the passage, the retaining element being displaceable between a first, non-retaining position in which the retaining element is accessible from the first end of the body member and a second, retaining position in which the retaining element is received within the passage and acts on at least a part of the body member for retaining the body member in position relative to a component of the screen deck, a head portion of the retaining element defining a receiving formation therein for receiving an engaging formation of a screening module, when the retaining element is in its second position, to assist in laterally retaining the screening module relative to the screen deck.

* * * * *